United States Patent [19]

Divisek et al.

[11] 4,304,643

[45] Dec. 8, 1981

[54] PROCESS FOR THE ELECTROLYSIS OF SULFUR DIOXIDE SOLUTIONS

[75] Inventors: Jiri Divisek; Heinrich Schmitz, both of Jülich; Bernd D. Struck, Langerwehe, all of Fed. Rep. of Germany

[73] Assignee: Kernforschungsanlage Julich Gesellschaft mit beschrankter Haftung, Jülich, Fed. Rep. of Germany

[21] Appl. No.: 66,861

[22] Filed: Aug. 15, 1979

[30] Foreign Application Priority Data

Aug. 19, 1978 [DE] Fed. Rep. of Germany ..... 2836353

[51] Int. Cl.[3] ..... C25B 1/00; C25B 1/02

[52] U.S. Cl. ..... 204/104; 204/129; 204/130

[58] Field of Search ..... 204/104, 222, 129, 290 R, 204/294, 130

[56] References Cited

U.S. PATENT DOCUMENTS

| | | | |
|---|---|---|---|
| 704,831 | 7/1902 | Jacobs | 204/104 |
| 885,054 | 4/1908 | Jungner | 204/104 |
| 928,844 | 7/1909 | DeBrialles | 204/104 X |
| 3,824,163 | 7/1974 | Maget | 204/130 |
| 3,888,750 | 6/1975 | Brecher et al. | 204/129 |
| 3,945,892 | 3/1976 | James et al. | 204/1 R |
| 3,968,273 | 7/1976 | Kastening et al. | 204/294 |
| 4,124,453 | 11/1978 | Fleischmann et al. | 204/1 R |
| 4,142,949 | 3/1979 | Faul et al. | 204/294 |
| 4,191,619 | 3/1980 | Struck | 204/104 |
| 4,217,191 | 8/1980 | Doniat et al. | 204/130 |

OTHER PUBLICATIONS

"Oxidation of $SO_2$ at Activated Anodes During Electrolysis of Sulfates" by I. P. Voroshilov et al., Zhurnal Prik. Khimii, vol. 45, #8, pp. 1743–1748, Aug. 1972.

Wiesener, "The Electrochemical Oxidation of Sulphur Dioxide at Porous Catalysed Carbon Electrodes in Sulphuric Acid", *Electrochimica Acta,* (1973), 18, pp. 185–189.

*Primary Examiner*—R. L. Andrews

*Attorney, Agent, or Firm*—Frishauf, Holtz, Goodman & Woodward

[57] ABSTRACT

Particles of electrically conducting activated carbon of about 500 to 1,000 $m^2/g$ specific surface added to an electrolyte provided by a solution of sulfur dioxide in water are found to provide a substantial reduction of the electrical energy requirement in the electrolysis of such an electrolyte for the production of hydrogen and sulfuric acid. A further reduction of energy consumption is obtained by additionally introducing iodine in the electrolyte in an amount not exceeding 1% by weight of the entire solution. Use of an anode in which the surface of a graphite base body is coated with a thin layer of activated carbon bonded to the graphite body by means of a binder, such as rubber, also reduces the electrical energy requirement for the electrolysis. To coat the surface of the electrode, carbon particles are first dispersed in a rubber solution and the suspension is then applied to the surface of the graphite body as a thin layer.

4 Claims, 5 Drawing Figures

PROCESS FOR THE ELECTROLYSIS OF SULFUR DIOXIDE SOLUTIONS

This invention concerns a process and an anode electrode for the production of hydrogen and sulfuric acid, by electro-chemical treatment of an electrolyte provided by an aqueous solution of sulfur dioxide, in an electrolysis cell through which electric current is passed by means of electrodes having their working surfaces immersed in the electrolyte.

Hydrogen is of increasing industrial importance, both as a carrier of energy and as a basic raw material. In chemical industry sulfuric acid is likewise an important basic material for chemical industry.

The production of sulfuric acid has long been a well known art. The considerable choice of processes for production of hydrogen also exists in the state of the art. A process is also known in which sulfuric acid and hydrogen are simultaneously produced. In this known process an aqueous solution of sulfur dioxide is subjected to an electrochemical treatment. In this instance sulfuric acid is synthetically formed from the water and the sulfur dioxide utilized as starting material and hydrogen is at the same time formed as the result of the decomposition of water taking place in the process, the hydrogen being liberated at the cathode. (compare Das, Sc. Indian J. Chem. 9 (71) 1008–1009 and also Voroshilov, I.P., Zhurnal Prikladnoi, Khimii, 45 (72) 1743–1748)

The last mentioned process has the advantage that both the sulfuric acid and the hydrogen are useful in industry, so that practically no waste material is formed. There is a third further advantage that in case the sulfuric acid is not intended to be wholly or in part a product of the process, the thermal decomposition of sulfuric acid can supply sulfur dioxide that can be fed back into the process. But, nevertheless, in the known ways of carrying out the process, a very high expenditure is necessary for electrical energy, a high valued form of energy.

It has already been tried to reduce the amount of engery necessary for carrying out the process, resulting in the proposal of using instead of simple graphite electrodes, electrodes of graphite with specially shaped surfaces. Known electrodes resulting from this suggestion have a basic body of porous graphite. A mixture of vanadium oxide and/or alumina is applied to this basic body on account of its catalytic effect, these oxides being drawn into the pores of the electrodes as the result of the porosity of the basic body (see Wiesener, K., Electrochimica Acta, (1973) 18,185–189). The necessary energy expense is in fact reduced thereby, but the expense is still disproportionately high for any application in industrial practice. For further reduction of the energy consumption, it has also been proposed to apply platinum to the surface of the basic electrode body (compare Das, Sc, Indian J. Chem. 9 (71) 1008–1009; Vooroshilov, I. P., Zhurnal Prikladnoi, Khimii, 45 (72) 1743–1748; U.S. Pat. No. 3,888,750). The use of platinum is, however, an expense that is not warranted for a large scale industrial process. This applies even where an electrode used according to an unpublished proposal according to which the platinum is applied to a graphitic basic body together with carbon or graphite.

It is an object of the present invention to provide a process and an anode electrode for the production of hydrogen and sulfuric acid in order to obtain a substantial reduction of the electrical energy requirement and in particular to provide an anode which can be manufactured in a simple way.

SUMMARY OF THE INVENTION

Briefly, electrically conducting activated carbon, typically small particles thereof, are brought into contact with the electrolyte and at least from time to time into contact with the electrodes. A particularly useful version of the process of the invention is provided by suspending the activated carbon in finely divided form in the electrolyte. In this case the activated carbon is supplied in such quantity (up to about 25 g per 100 ml solution) that the suspended particles in the course of their random movements will come into contact with the electrodes often enough to serve as electrical charge carriers.

A further improvement is provided, regarding the amount of energy consumption in the process, by additionally introducing iodine in the electrolyte in an amount not exceeding 1% by weight of the entire solution (that is, the solution weight exclusive of the weight of the suspended carbon particles).

A further and likewise advantageous variation of the process of the invention is provided when an electrode is used, particularly for the anode, in which the surface of a graphite base body is coated with a thin layer of activated carbon bonded to the graphite body by means of a binder. It has been found highly effective to utilize rubber, specifically caoutchone, as the binder. The carbon particles are first dispersed in a rubber solution (for example, in 1:1 xylene/benzene mixture) and the solution of the activated carbon suspended therein is then applied to the surface of the body of the electrode as a thin layer. This electrode constituted according to the invention is usable for the purposes of the invention both instead of the suspension of activated carbon in the electrolyte as aforesaid and also along with an electrolyte in which activated carbon is suspended. The electrode constituted according to the invention has furthermore the advantage that by its use the electrolysis efficiency can be substantially increased and also the still further great advantage that the electrode is resistant to attack by acid media, particularly $H_2SO_4$. At the same time, the electrode has the advantage that it has a very large active surface.

BRIEF DESCRIPTION OF THE DRAWINGS

Results of the illustrative examples of the process carried out in accordance with the invention are described in the drawings of which the five figures are all graphs in which the anode potential with respect to standard the Hydrogen Electrode (SHE) (in volts) is plotted against the measured current density (in amperes per square decimeter; $A/dm^2$).

DESCRIPTION OF ILLUSTRATIVE EXAMPLES

EXAMPLE 1

Figure 1:
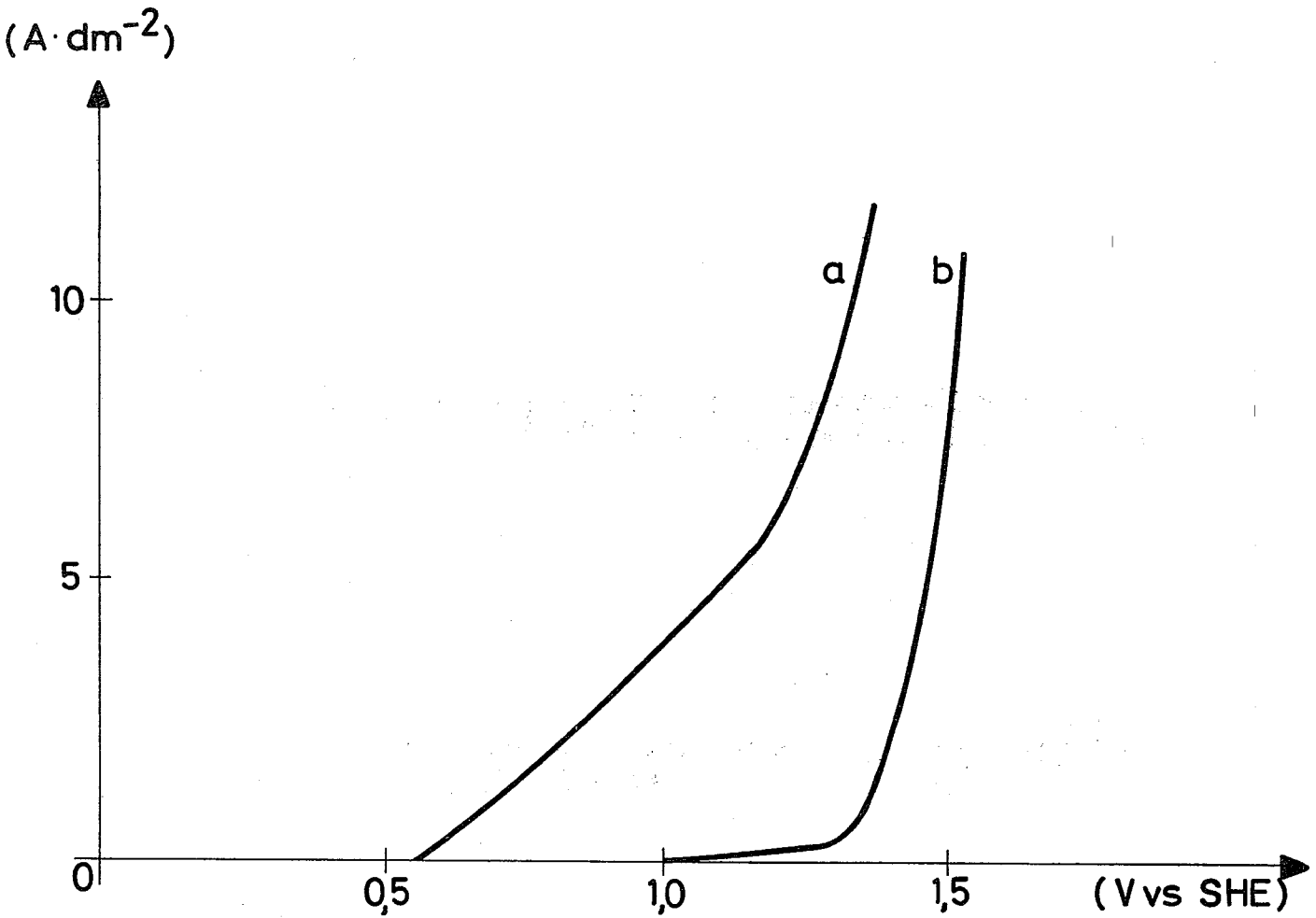
FIGS. 1, 2 and 3 refer to Examples 1, 2, and 3 described below.

Graphite was used as the electrode material. Activated carbon particles (about 500 to 1000 $m^2/g$ specific surface after heat treatment; 50% of the particles being smaller than 60μ; no particle size greater than 100μ) were added to an aqueous electrolyte containing 44% by weight $H_2SO_4$ so as to produce an agitated suspension of the carbon particles in the solution in a proportion of 17.5 g of activated carbon per 100 ml of solution. Different potentials were applied and the resulting current densities were measured. The results are shown in curve a of FIG. 1. Similar measurements were made under the same conditions except for the presence of activated carbon in the electrolyte and the results are given in curve b of FIG. 1. Curve a shows a clear shift at all values of current density towards substantially more favorably energy consumption values.

EXAMPLE 2

Figure 2:
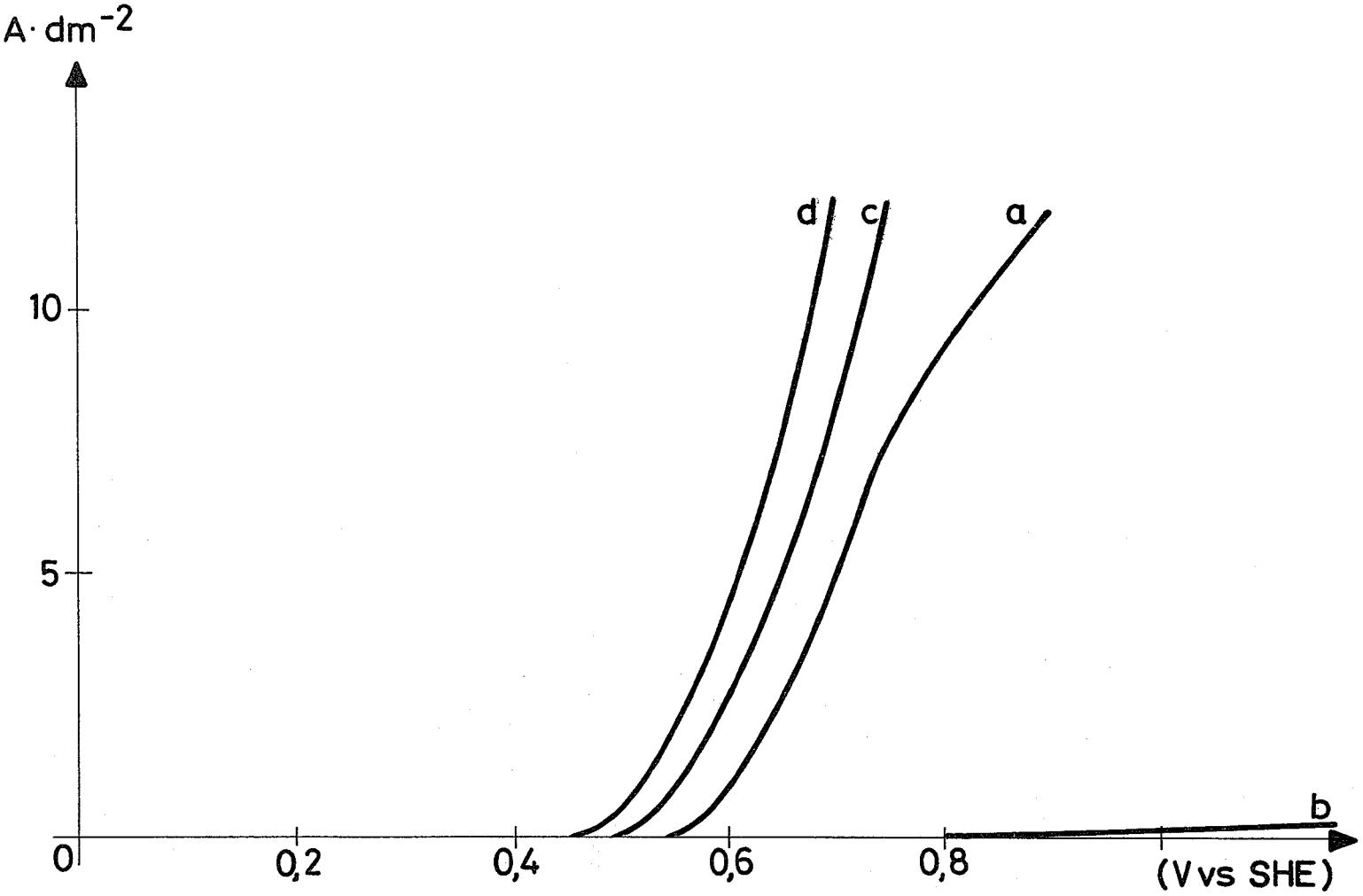

An electrode of vitreous carbon was coated with electrically conducting activated carbon (bonded by means of a rubber binder) with a thickness of a few tenths of a millimeter. This electrode was utilized under the same solution conditions as in Example 1 for electrolysis, at first without the addition of activated carbon to the electrolyte. Curve a of FIG. 2 shows the relation of potential and current density thereby obtained. Curve b of FIG. 2 corresponds to electrolysis under the same conditions except that the electrode was not coated with the layer of activated carbon. The comparison of these two curves shows that without the coating it was difficult to obtain any appreciable current density without the potential range of the measurements, indicating a tremendous shift towards more favorable energy consumption values with the electrode coated in accordance with the invention. Curve c shows the measurements made when the electrode of this example made in accordance with the invention was utilized with an electrolyte in which activated carbon was suspended in the manner described in Example 1. The effectiveness of the invention in reducing energy consumption was still further increased when the electrode of the present example was so used.

Thereafter the electrode coated as above described was used with an increased addition of activated carbon to the electrolyte compared to Example 1, in this case 25 g of activated carbon per 100 ml of 44% $H_2SO_4$ solution. The resulting potential curve is curve d of FIG. 2, which clearly shows an improvement compared with the other curves shown on the figure. Attention is particularly called to the comparison of curve d and curve a which indicates how great the energy saving can be when activated carbon is dispersed in the electrolyte, compared with the energy consumption that is required even when an electrode coated with activated carbon in accordance with the present invention is used without the addition of activated carbon particles to the electrolyte.

EXAMPLE 3

Figure 3:
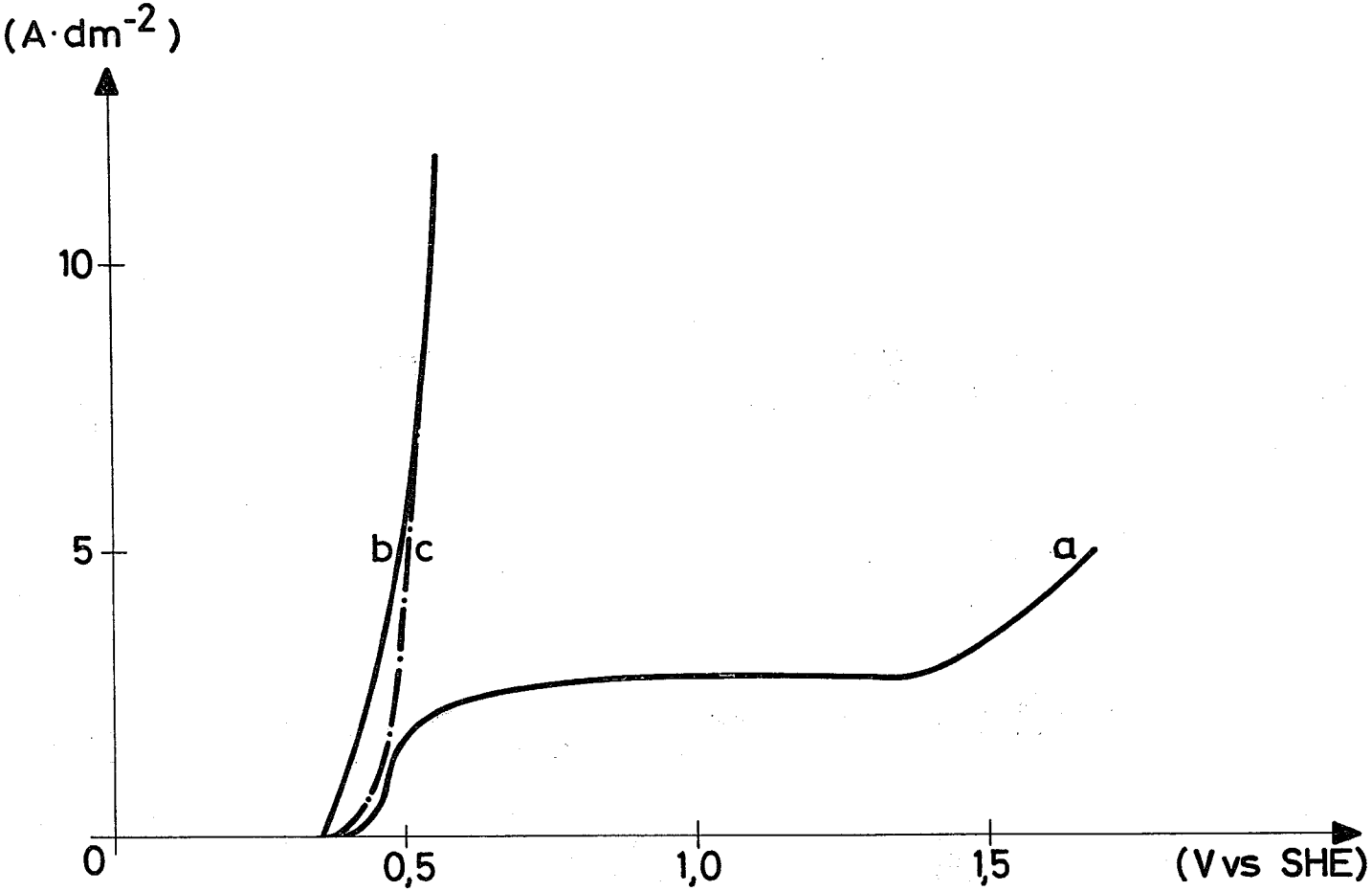

Iodine was added to a solution of the composition given in Example 1, in the proportion of 1 g of iodine per 100 ml of 44% $H_2SO_4$ aqueous solution. Measurements were first taken without the provision of any other features of the invention. Curve a of FIG. 3 illustrates the resulting potential curve. Measurements were then made after suspension of activated carbon in the electrolyte in the same proportion as described in Example 1. Curve b of FIG. 3 is the resulting potential curve. The electrode used, which was a graphite electrode, was then replaced by an electrode identical thereto except for a coating of activated carbon of the kind described in Example 2, the electrolyte in this case being, used, as in the case of curve a, without addition of activated carbon particles in suspension.

From the comparison of the curves of FIG. 3 certain facts stand out. For low current density the addition of iodine alone produces a relatively steep curve at low values of potential, a result that is greatly advantageous. Since the solubility of iodine in an aqueous solution of sulfur dioxide is limited, an improvement of the energy requirements by increased addition of iodine is not possible. An improvement is nevertheless obtained, as shown in comparison of curve b with curve a, by the suspension of activated carbon in the solution. Likewise, an improvement is possible by use of the coated electrode, as shown by curve c.

It has been found that the use of a suspension of activated carbon in an electrolyte in accordance with the present invention has the further advantage that the activated carbon so strongly absorbs the iodine that practically no analytically detectable quantity of iodine gets out of the electrolysis cell when the electrolyte is removed when it is desired to use the sulfuric acid formed to produce more sulfur dioxide as a recycled raw material, after thermal decomposition of the sulfuric acid.

Figure 4:
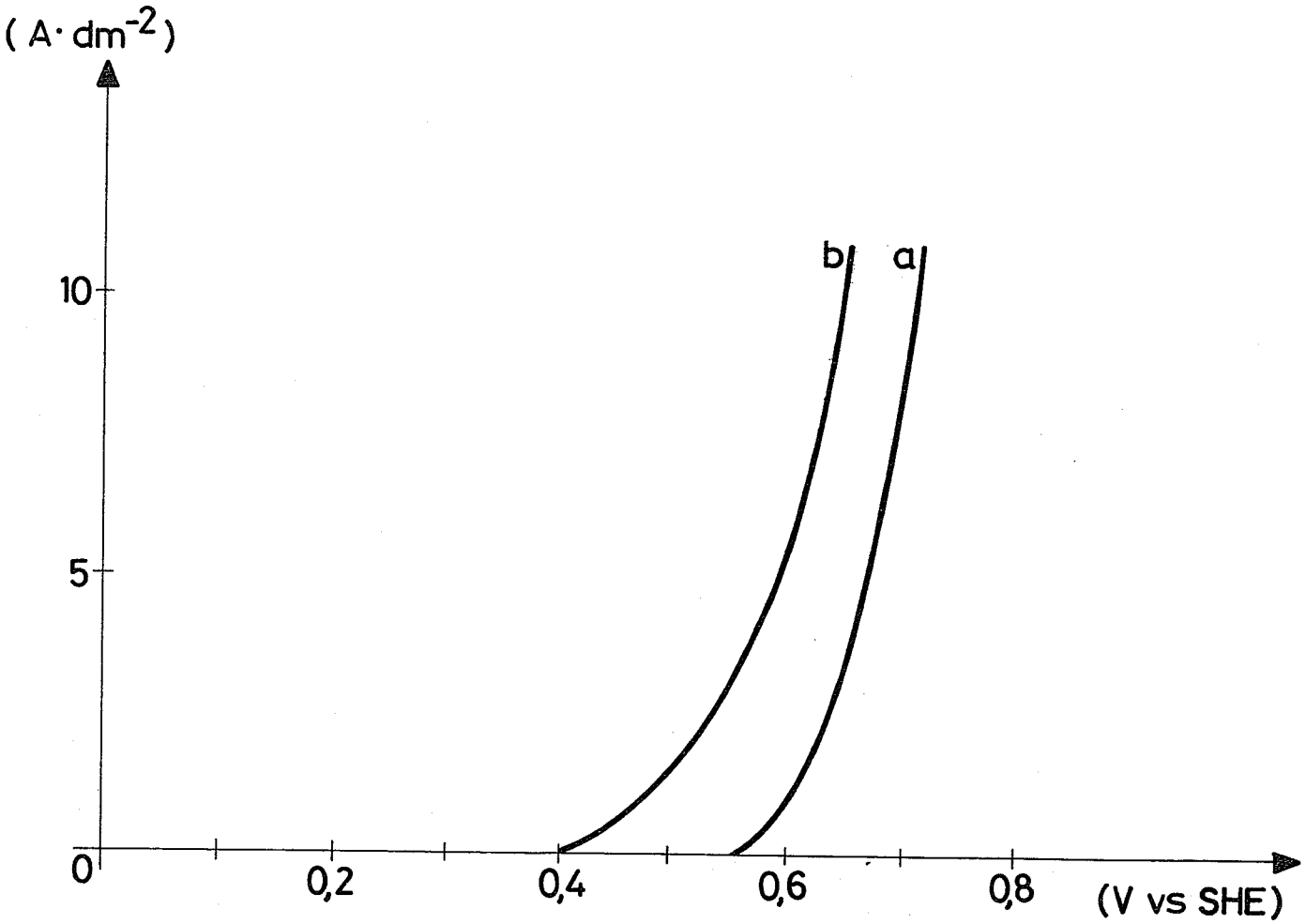
FIG. 4 compares the potential of platinized electrodes used in a prior art process with that of a similar electrode used in the process of the present invention, and FIG. 5 compares the potential in three different prior art processes with the potential of an electrode in a process of the present invention.

FIG. 4 shows a comparison of the course of potential with respect to current density in case a platinized electrode is used for electrolysis as in the prior art, represented by curve a, with the potential curve for an identical electrode utilized with an electolyte in which activated carbon is suspended in accordance with the invention, in this case again in a proportion of 17.5 g of activated carbon for 100 ml of 44% $H_2SO_4$ aqueous solution, the comparison of these curves making clear that by utilizing the present invention a further improvement regarding the energy consumption is obtainable also when platinized electrodes are used.

Figure 5:
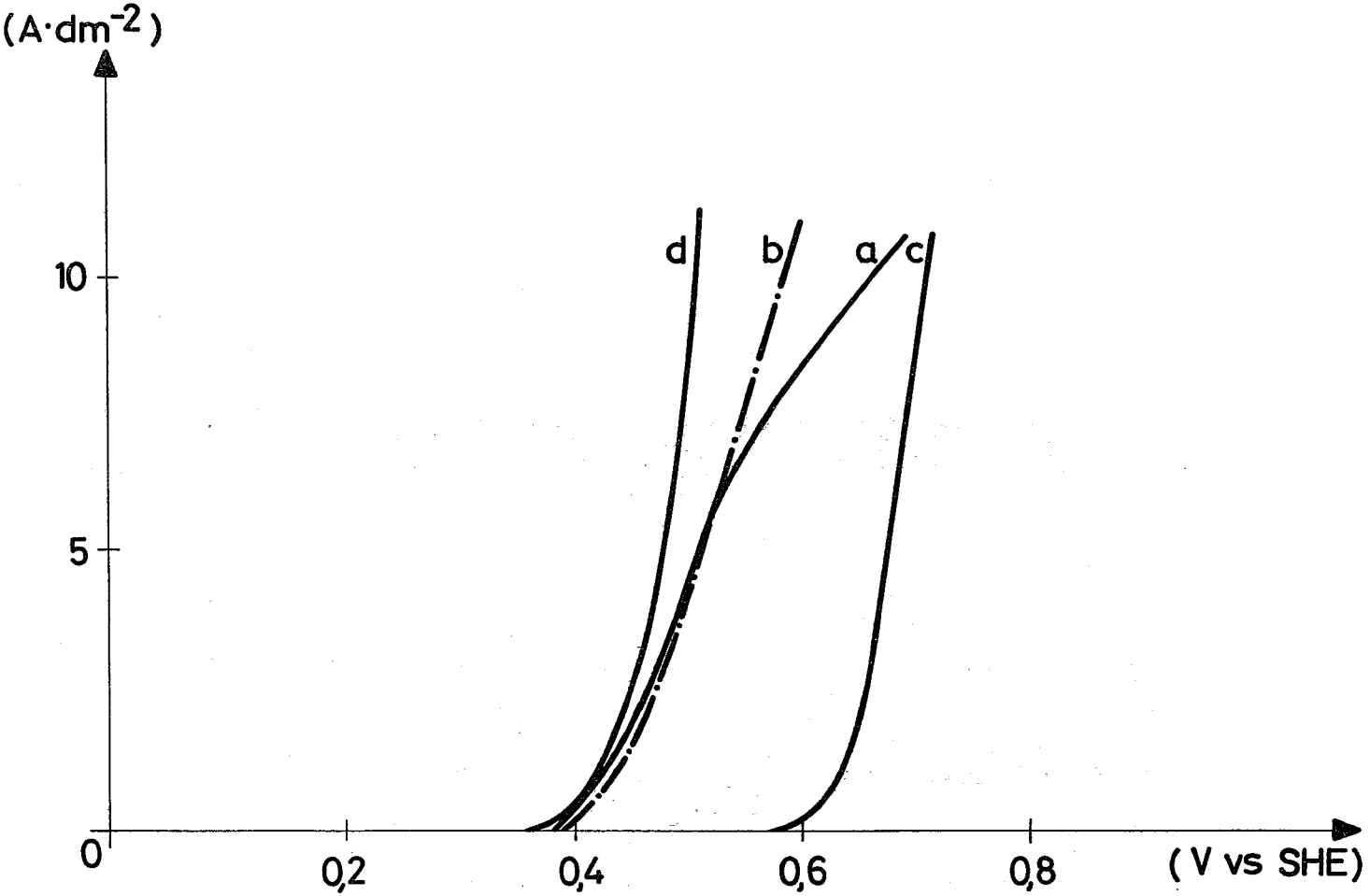

In order to show still more clearly the reduction of energy consumption available by utilization of the features of the present invention, FIG. 5 makes the following comparisons:

Curve a: the course of potential with increasing current density in a 30% $H_2SO_4$ solution at 60° C. with use of a porous platinized electrode;

Curve b: the course of potential under the same condition as in curve a except for the addition of a $Na_2SO_4$ solution (compare Voroshilov, I. P., Zhurnal Prikladnoi Khimii, 45 (72) 1743–1748);

Curve c: the course of potential in a 25% $H_2SO_4$ solution at 30° C. with use of platinized platinum electrodes.

Compared in FIG. 5 with the above mentioned prior art electrolysis data is curve d, which results from the use of activated carbon in the proportion of 17.5 g per 100 ml of solution, the solution being in this case 30% $H_2SO_4$ at a temperature of 20° C., however with addition of a quantity of iodine in the amount given in Example 3. This shows with great clarity that by far the best result with respect to the energy consumption of the electrolysis are obtained by the utilization of the features of the present invention.

In all the examples described above in which electrically conducting activated carbon (the conductivity of which preferably approaches as best that of graphite as obtainable by high temperature treatment) was suspended in a solution, the activated carbon was capable of being separated from the electrolyte solution in a simple manner, by filtration or by decantation. The results were obtained at room temperature, except for curves a, b and c of FIG. 5 in which cases the temperatures are given above.

Although the invention has been described with reference to particular illustrative examples, it will be understood that variations and modifications are possible within the inventive concept.

We claim:

1. A process for producing hydrogen and sulfuric acid by electrochemical treatment of an electrolyte provided by an aqueous solution of sulfur dioxide in an electrolysis cell, by means of electrodes dipping into the electrolyte and providing for electric current flow therethrough, in which there is the improvement that electrically conducting carbon particles activated without depositing thereon or otherwise adding thereto any metallic substance are brought into continuous contact with the electrolyte and also into at least intermittent contact with the electrodes.

2. A process as defined in claim 1 in which at least the bulk of said activated carbon particles are no greater than 100$\mu$ in diameter and are suspended in the electrolyte.

3. A process for producing hydrogen and sulfuric acid by electrochemical treatment of an electrolyte provided by an aqueous solution of sulfur dioxide in an electrolysis cell, by means of electrodes dipping into the electrolyte and providing for electric current flow therethrough, in which there is the improvement that iodine is present in solution in said electrolyte to an extent not exceeding 1% by weight of the entire solution, and electrically conducting activated carbon is placed in continuous contact with the electrolyte and also, at least from time to time, in contact with the electrodes.

4. A process as defined in claim 1 in which at least some of said activated carbon particles are in a thin layer of particles held together on the surface of the anode by a binder material.

* * * * *